US005263454A

United States Patent [19]

Imagawa

[11] Patent Number: 5,263,454

[45] Date of Patent: Nov. 23, 1993

[54] ENGINE FOR PORTABLE WORKING MACHINE

[75] Inventor: Yoichi Imagawa, Chiyoda, Japan

[73] Assignee: Ryobi Limited, Tokyo, Japan

[21] Appl. No.: 931,594

[22] Filed: Aug. 18, 1992

[30] Foreign Application Priority Data

Aug. 21, 1991 [JP] Japan ..... 3-074212[U]

[51] Int. Cl.[5] ..... F02M 37/12

[52] U.S. Cl. ..... 123/437; 261/35; 261/DIG. 68

[58] Field of Search ..... 123/438, 439, 52 M, 123/687, 437; 261/35, DIG. 68

[56] References Cited

U.S. PATENT DOCUMENTS

| | | | |
|---|---|---|---|
| 3,181,843 | 5/1965 | Brown et al. | 261/DIG. 68 |
| 3,738,336 | 6/1973 | Holland | 261/DIG. 68 |
| 4,168,288 | 9/1979 | Nau et al. | 261/35 |
| 4,508,068 | 4/1985 | Tuggle et al. | 261/DIG. 68 |
| 4,752,420 | 6/1988 | Nagasaka et al. | 261/DIG. 68 |
| 4,949,692 | 8/1990 | Devine | 261/DIG. 68 |

*Primary Examiner*—Willis R. Wolfe

*Attorney, Agent, or Firm*—Brooks & Kushman

[57] ABSTRACT

An engine for a portable working machine includes a carburetor having a fuel supply device which is to be operated by an intake pipe of a cylinder head provided with an intake valve and an exhaust valve, and a pulse pickup passage which is in fluid communication with the carburetor and which is connected to an inner wall of the intake pipe. The passage is provided at a connection portion between the intake pipe and the carburetor.

9 Claims, 7 Drawing Sheets

PRIOR ART

PRIOR ART

ENGINE FOR PORTABLE WORKING MACHINE

BACKGROUND OF THE INVENTION

The present invention relates to a four cycle engine provided with a diaphragm type carburetor, and more particularly to an engine for a portable working machine, in which pulsating pressure for driving a fuel pump may be picked up.

In a conventional engine for a portable working machine such as a trimmer, a posture of the engine is not kept constant during the operation, and it often operates under the condition that a crank shaft of the engine is slanted at angles 40° to 50° in the back and forth and right and left directions relative to a horizontal position. Accordingly, due to the positional relationship of the fuel supply device such as a carburetor, two-cycle engines are more frequently used instead of four-cycle engines. As shown in FIG. 9, the conventional two-cycle engine includes a crank shaft 1, a piston 2, a connecting rod 3, a cylinder 4, an intake port 5 formed in the cylinder 4, a carburetor 6, a heat insulator 7 installed between the cylinder 4 and the carburetor 6, and pulsating pressure pickup ports 8 and 8*a* which are in communication with a diaphragm type fuel pump chamber (not shown) of the carburetor and a crank chamber space S1 and the like. As well known in the two-cycle engine, the intake port is interrupted from the crank chamber space S1 by the downward stroke of the piston 2, whereas the intake port is in communication with the crank chamber space S1 by the upward stroke of the piston 2. In this case, the pressure within the crank chamber is changed, so that the pulsating pressure generated thereby may be utilized as a drive source for operating the fuel pump within the carburetor. The smaller the volume of the space S1, the large the pressure change of the space S1 caused by the reciprocating motion of the piston will become.

Also, in a four-cycle engine, as shown in FIG. 10, a cam shaft 9 and the like as well as a crank shaft 1 are disposed in a crank chamber space S2, and a volume of the space S2 is larger than the space S1 of the two-cycle engine even if a volume of lubricant 26 is subtracted from the volume of the space S2. Accordingly, a pulsating pressure enough to drive the fuel pump of the diaphragm type carburetor will not be generated.

SUMMARY OF THE INVENTION

In view of the above, although the present inventor tried to use an overhead valve or an overhead cam engine which has a large amount of intake air per unit time, i.e., a four-cycle engine provided with an intake valve and an exhaust valve at its cylinder head, the present inventor has found the following disadvantages. Firstly, the present invention relates to a magnitude of the pulsating pressure of gas (almost air) within the crank chamber for driving a fuel pump which belongs to a carburetor operable even in a slanted position, i.e., a diaphragm type carburetor. As mentioned above, the gas space S2 of the crank chamber of the four-cycle engine is larger in volume than the gas space S1 of the crank chamber of the two cycle engine. Accordingly, the reciprocating motion of the four-cycle engine is not sufficient to generate a pulsating pressure for driving the fuel pump of the carburetor.

Secondly, portable working machines such as a trimmer, a chain saw and the like have a high rpm for operation. Accordingly, in the case of the four-cycle engine is used, it is necessary to generate pulsating pressure sufficient at a high speed.

Accordingly, an object of the present invention is to provide an engine for a portable working machine, which uses a diaphragm type carburetor at a high speed for a four-cycle engine in the operation in a slanted position.

According to a first aspect of the present invention, there is provided a portable working machine engine in which a carburetor has a fuel supply device which is to be operated by an intake pipe of a cylinder head provided with an intake valve and an exhaust valve, and a pulse pickup passage which is in fluid communication with the carburetor and which is connected to an inner wall of the intake pipe is provided at a connection portion between the intake pipe and the carburetor.

According to a second aspect of the present invention, a part of the pulse pickup passage is formed by a casting step.

According to the present invention, a diaphragm type carburetor is applied to an overhead type four-cycle engine. The carburetor is mounted onto an intake pipe of the engine through a connection portion such as a heat insulator. A pulse pickup passage is in fluid communication with an inner wall of the intake pipe. A pulsating pressure is picked up from the pulse pickup passage for actuating a diaphragm of the carburetor. The passage communicates the intake pipe with the diaphragm of the carburetor. A pump diaphragm is operated in cooperation with a pulsating pressure operation chamber and performs a wavy motion in response to the pulsating pressure within the pulsating pressure operation chamber. A pump chamber is provided in contact with the pump diaphragm so that its pressure is decreased when the pressure within the pulsating pressure operation chamber is kept under a negative pressure. Fuel is supplied to the pump chamber through a fuel inlet passage past an inlet valve provided within the pump chamber. When the fuel is supplied to the pump chamber, the outlet valve is closed. Also, when the pressure within the pulsating pressure operation chamber is kept under a positive pressure, the pressure within the pump chamber is increased, and the outlet valve is opened so that the fuel is supplied to a metering chamber through a passage and a needle valve.

A pair of integral lever portions which are swingable about a support shaft are provided in the metering chamber. The needle valve is brought into contact with the end of the lever portion, and a knob fixed to the metering diaphragm is brought into contact with the end of the other lever portion. An air vent chamber is released to the atmosphere. A nozzle projecting into a hole portion which is in fluid communication with an interior of the intake pipe of the engine is in fluid communication with the metering chamber through a main jet portion.

With such an engine and a carburetor, a pressure within the intake port is varied in response to a load of the engine, and the metering diaphragm is moved up and down due to the difference between the intake pressure of the engine and the atmospheric pressure. The motion of the metering diaphragm is transmitted to the lever portions thereby controlling the needle valve to limit the rate of fuel. Accordingly, unlike the device in the conventional two-cycle engine in which a special passage is formed for picking up a pressure of the crank chamber, such a complicated passage is dispensed with and the carburetor is connected to the pulsating pressure pickup passage. According to the present invention, it is possible to effectively supply a predetermined amount of fuel, which is needed for operating the engine at a high speed, to the carburetor.

DESCRIPTION OF THE PREFERRED EMBODIMENTS

The present invention will now be described in detail with reference to the accompanying drawings.

Figure 1:
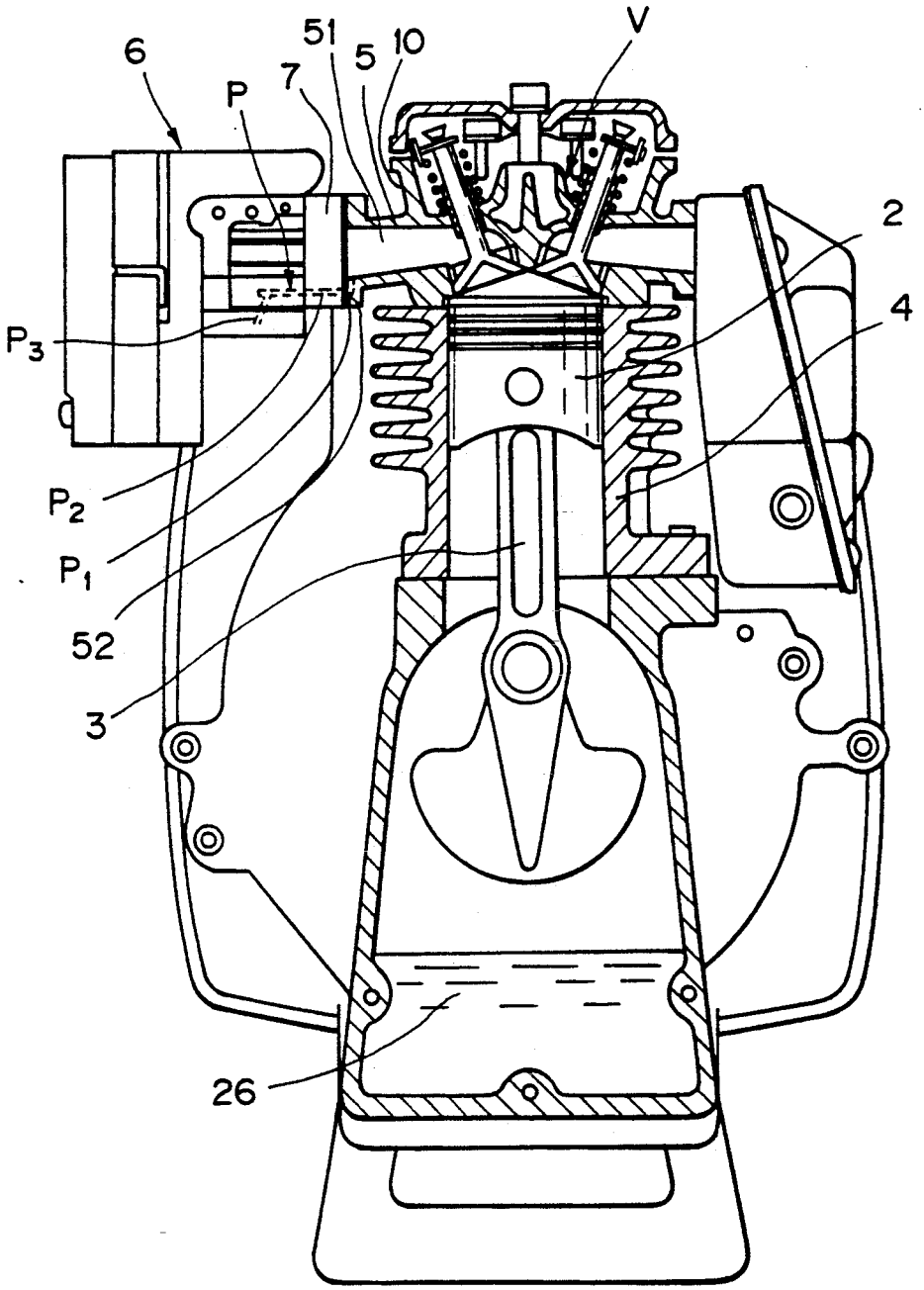
FIG. 1 is a cross sectional view showing an engine according to the present invention.
Figure 2:
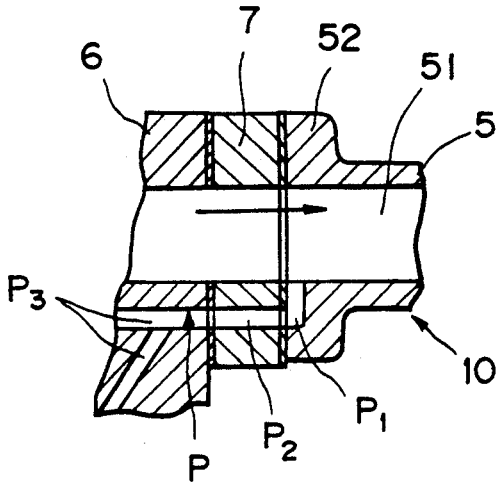
FIG. 2 is a cross sectional view showing a primary part of a pulse pickup passage according to the invention.
Figure 3:
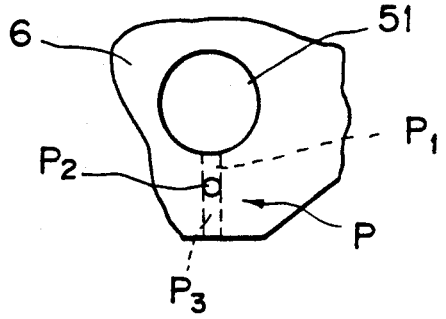
FIG. 3 is a side elevational view showing the pulse pickup passage shown in FIG. 2.

FIG. 1 is a longitudinal sectional view showing a four-cycle engine provided with a device according to the present invention. FIGS. 2 through 5 show primary parts of the device shown in FIG. 1. FIGS. 1 to 5 show a carburetor 6, a heat insulator 7, a cylinder head 10, and an intake pipe 5 for the cylinder head 10, and a detail of components for picking up a pulsating pressure. More specifically, a pulse pick up passage P which is in fluid communication with an intake port 51 is formed at an end face of a flange 52 of the intake pipe 5 having the intake port 51 provided in the cylinder head 10 in which a valve mechanism V is accommodated. The passage P comprises a first vertical path $P_1$ formed in the flange 52 of the intake pipe 5, a second horizontal path $P_2$ formed in the heat insulator 7 and a third paths $P_3$ formed in the carburetor 6. The carburetor 6 is shown in more detail in FIG. 5. The third paths $P_3$ are in cooperation with a pulsating pressure operation chamber 62 which has a pump diaphragm 621 for performing a wavy or pulsating motion in response to the pulsating pressure. A pump chamber 65 is arranged in contact with the the pump diaphragm 621, so that its pressure is decreased when the pressure of the pulsating pressure operation chamber 62 is kept under a negative pressure. A fuel will be supplied through a fuel inlet passage 63 by an inlet valve 64 of the pump chamber 65. When the fuel is supplied thereto, an outlet valve 66 will be closed. Further, when the pressure within the pulsating pressure operation chamber 62 is kept under a positive pressure, the pressure of the pump chamber 62 is increased, so that the outlet valve 66 is opened and the fuel is supplied to a metering chamber 612 through a passage 67, a needle valve 68 and the like. In the metering chamber 612, lever portions 610 and 611 are integrally formed on both sides of a support shaft 69 and are swingable about the support shaft 69. The needle valve 68 is provided at an end of the lever portion 610 so as to open and close the passage 67. An end of the lever portion 611 is to be brought into contact with a knob 613 fixed to a metering diaphragm 614.

Figure 4:
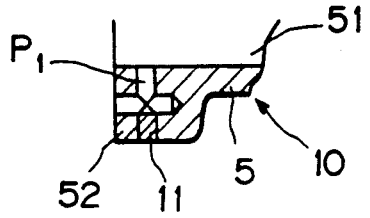
FIG. 4 is a cross sectional view showing a pulse pickup passage according to another embodiment of the invention.
Figure 5:
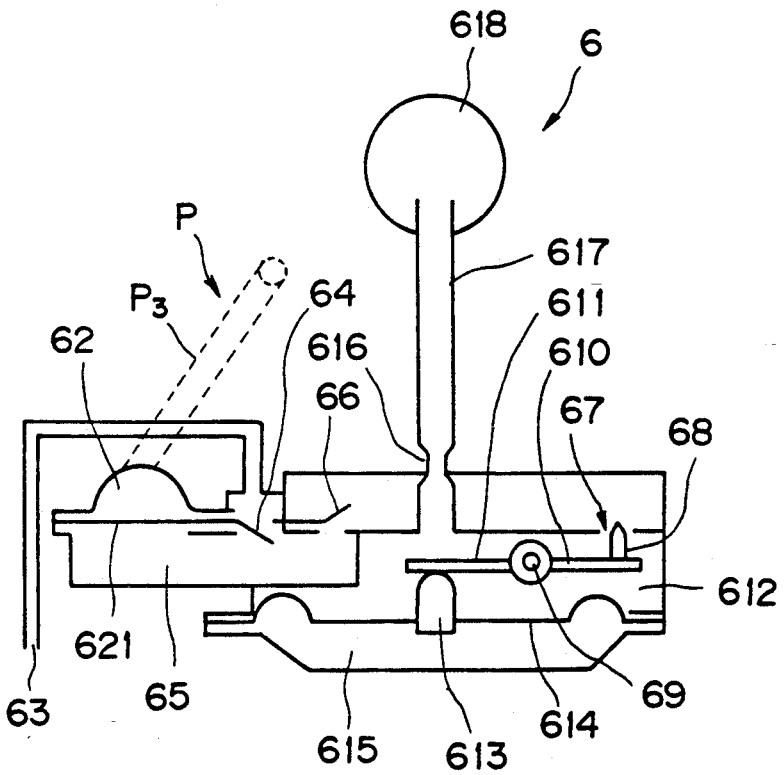
FIG. 5 is a cross sectional view showing a primary part of the carburetor.

An air vent chamber 615 is arranged in the vicinity of the metering diaphragm 614 and is released to the atmosphere. A nozzle 617 extending into a hole portion 618 which communicates with the intake pipe 5 is in fluid communication with the metering chamber 612 through a main jet portion 616. The pressure within the intake pipe 5 is varied in response to the load of the engine. Due to the difference between the intake pressure of the engine and the atmospheric pressure, the metering diaphragm 614 is moved up and down, so that the lever portions 610 and 611 is subjected to the motion, thereby controlling the needle valve 68 and controlling the supply amount of the fuel through the nozzle 617 with the main jet portion 616. As is apparent from FIGS. 2 and 3, the first passage $P_1$ may be formed through a casting step during the casting operation of the cylinder head 10 or may be formed on a casting material by any other suitable step. Incidentally, as shown in FIG. 4, the first passage $P_1$ may be formed by machining the flange 52 of the intake pipe 5 provided in the cylinder head and providing a blind plug 11 in the passage. The first path $P_1$ and the second path $P_2$ may be formed together in the heat insulator 7.

Figure 6:
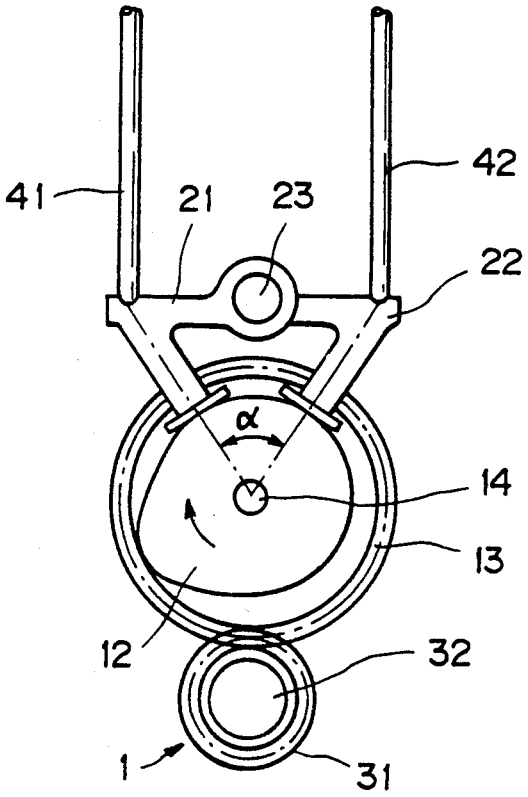
FIG. 6 is a frontal view showing a valve drive device.
Figure 7:
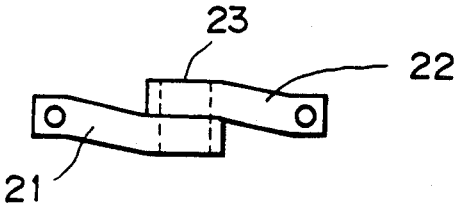
FIG. 7 is a plan view showing a lifter portion shown in FIG. 6.

FIG. 6 shows the valve drive mechanism which is composed of a single cam 12 and a pair of swing rotary lifters 21 and 22 which are in contact with the cam 12. The lifters 21 and 22 are rotated about a lifter shaft 23. A gear portion 13 of the cam 12 is engaged with a crank gear 23 about the crank shaft 1. One lifter 21 is connected to an exhaust valve push rod 41 and the other lifter 22 is connected to an intake valve push rod 42. As viewed from the above, as shown in FIG. 7, the lifters 21 and 22 are bent from the shaft portions toward the central portion. The exhaust valve push rod 41 and the intake valve push rod 42 are flush with each other in the same level. The shaft portion 32 of the crank shaft 1 is rotated in the counterclock direction as viewed from the power output side to the engine. The gear portion 13 of the cam engaged with the crank shaft gear 31 is rotated, and one of the lifters 21 and 22 is rotated, thereby opening the exhaust valve through the exhaust push rod 41.

Further, the cam 12 is rotated, one of the lifters 22 that contacts with the cam 21 is rotated, and the intake valve is opened through the intake side push rod 42, thereby closing the exhaust valve or the intake valve for a predetermined time.

Figure 8:
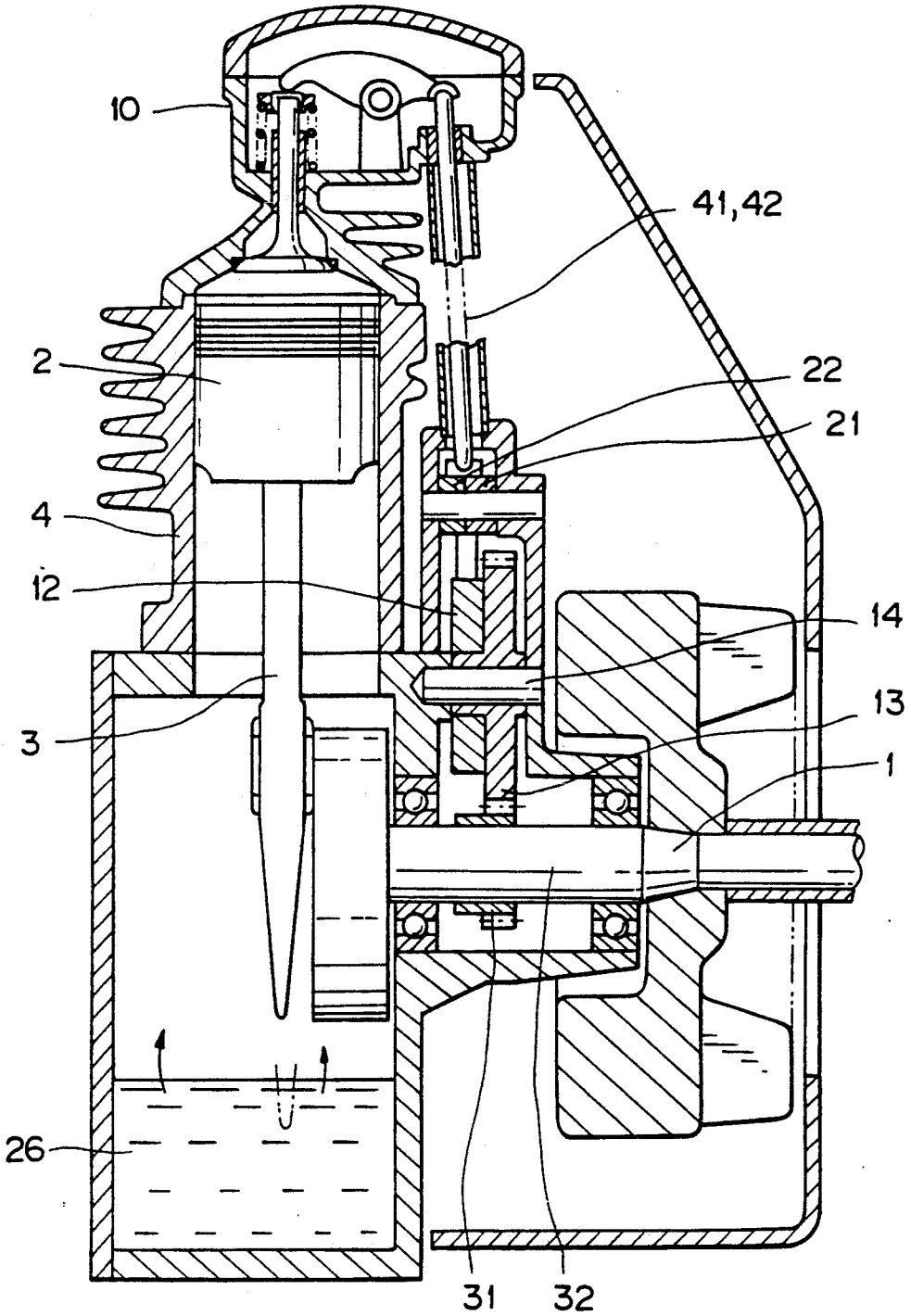
FIG. 8 is a cross sectional view showing an engine utilizing the valve drive device according to the present invention.
Figure 9:
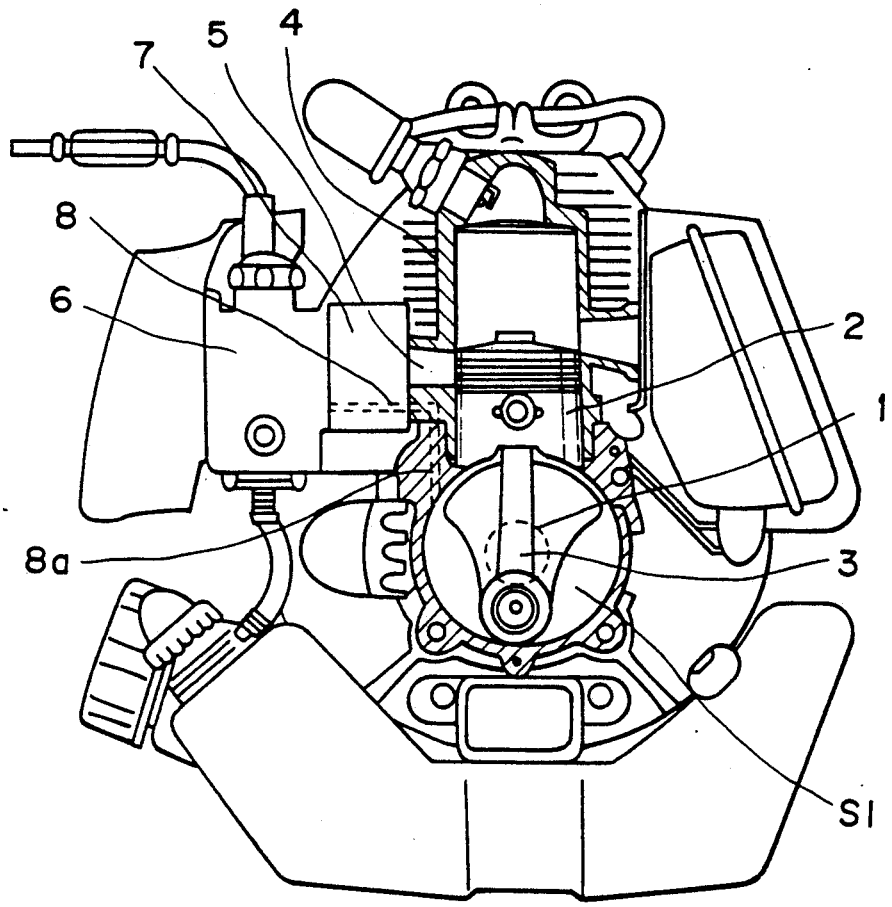
FIG. 9 is a cross sectional view showing a conventional two-cycle engine.
Figure 10:
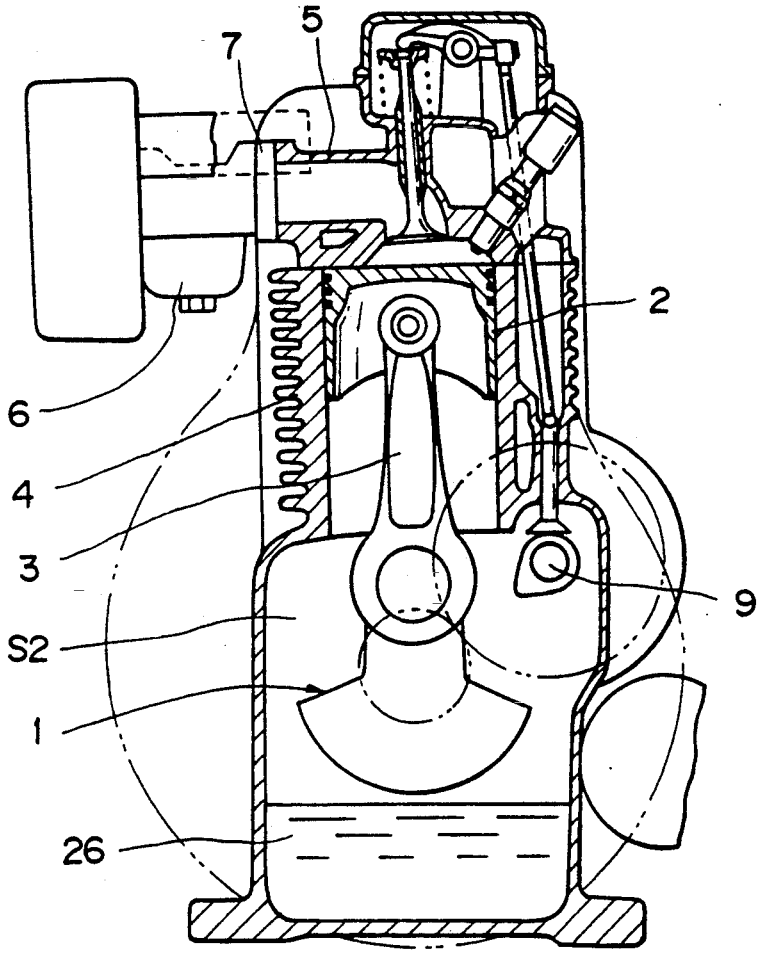
FIG. 10 is a cross sectional view showing a conventional four-cycle engine utilizing a conventional valve drive device.

The valve drive mechanism according to the foregoing embodiment is used in a portable working machine engine as shown in FIG. 8. The cam profiles of the push rod lift side and lowering side are substantially symmetrical with each other relative to a maximum lift point. Thus, by using the swing lifters, it is possible to differentiate the lift curves of the intake valve and the exhaust valve from each other.

As described above, in the portable working machine engine, it is possible to easily communicate the carburetor with the pulsating pressure pickup passage without providing any complicated passage as in the conventional case of the pickup of the pressure within the crank chamber. Also, it is possible to apply the device to a four-cycle engine provided in a cylinder head with an intake valve and an exhaust valve, i.e., an overhead cam engine having an overhead cam mechanism which engine has a large amount of suction air per unit time. Accordingly, it is possible to effectively supply fuel, which is needed for operating the portable working machine engine, to the diaphragm type carburetor. In addition, the first path $P_1$ may be produced during the die casting step of the cylinder head. Thus, it is easy to produce the device.

The present invention has been described in detail with reference to the embodiments but it is apparent that the invention is not limited to the specific embodiments. Various modifications are possible for those skilled in the art within the scope of the appended claims.

What is claimed is:

1. An engine for a portable working machine, comprising a carburetor having a fuel supply device which is to be operated by an intake pipe of a cylinder head provided with an intake valve and an exhaust valve, and a pulse pickup passage which is formed between the carburetor and an inner wall of the intake pipe so as to communicate the intake pipe and the carburetor with each other, said pulse pickup passage comprising first and second paths formed in a heat insulator so as to open to an intake port and a third path formed in the carburetor.

2. An engine according to claim 1, wherein a part of said pulse pickup passage is formed by a casting step.

3. An engine according to claim 1, wherein said pulse pickup passage is formed by a machining.

4. An engine according to claim 1, wherein said pulse pickup passage comprises a first path formed in a flange of the intake pipe, a second path formed in a heat insulator provided between the intake pipe and the carburetor, and a third path formed in the carburetor.

5. An engine according to claim 1, wherein said pulse pickup passage is in communication with a pulsating pressure operation chamber having a pump diaphragm for operating a fuel inlet valve of the carburetor.

6. An engine for a portable working machine, comprising a carburetor having a fuel supply device which is to be operated by an intake pipe of a cylinder head provided with an intake valve and an exhaust valve, and a pulse pickup passage which is formed between the carburetor and an inner wall of the intake pipe so as to communicate the intake pipe and the carburetor with each other, wherein said pulse pickup passage comprises a first path formed at an end face of a flange of the intake pipe, a second path formed in a heat insulator provided between the intake pipe and the carburetor, and a third path formed in the carburetor.

7. An engine according to claim 6, wherein a part of said pulse pickup passage is formed by a casting step.

8. An engine according to claim 6, wherein said pulse pickup passage is formed by a machining.

9. An engine according to claim 6, wherein said pulse pickup passage is in communication with a pulsating pressure operation chamber having a pump diaphragm for operating a fuel inlet valve of the carburetor.

* * * * *